United States Patent [19]

Aeschlimann

[11] Patent Number: 5,000,756

[45] Date of Patent: Mar. 19, 1991

[54] PROCESS FOR DYEING CELLULOSIC FIBRE MATERIALS WITH REACTIVE PHTHALOCYANINE DYES FROM BATH CONTAINING COLORLESS COMPOUNDS

[75] Inventor: Peter Aeschlimann, Allschwil, Switzerland

[73] Assignee: Ciba-Geigy Corporation, Ardsley, N.Y.

[21] Appl. No.: 444,468

[22] Filed: Dec. 1, 1989

[30] Foreign Application Priority Data

Dec. 6, 1988 [CH] Switzerland ..... 4509/88

[51] Int. Cl.[5] ..... D06P 1/38; D06P 3/66

[52] U.S. Cl. ..... 8/549; 8/532; 8/543; 8/586; 8/589; 8/590; 8/591; 8/605; 8/661; 8/918; 8/919

[58] Field of Search ..... 8/549, 590, 661, 589

[56] References Cited

U.S. PATENT DOCUMENTS 4,313,732 2/1982 Teague et al. ..... 8/541
4,877,413 10/1989 Sire et al. ..... 8/543

FOREIGN PATENT DOCUMENTS 210951 2/1987 European Pat. Off. .
278903 8/1988 European Pat. Off. .
934391 8/1963 United Kingdom .
974159 11/1964 United Kingdom .
982339 2/1965 United Kingdom .
1301402 12/1972 United Kingdom .

*Primary Examiner*—A. Lionel Clingman
*Attorney, Agent, or Firm*—George R. Dohmann; Edward McC. Roberts

[57] ABSTRACT

The invention relates to a process for dyeing cellulosic fibre materials with reactive dyes by the pad dyeing process in the process of an assistant, which process comprises the use of a mixture containing (a) at least one reactive dye of formula

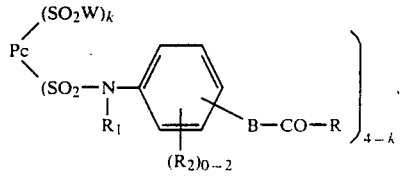

(1)

wherein Pc, W, k, $R_1$, $R_2$, B and R are as defined in claim 1, and (b) at least one colorless compound which contains at least one —$SO_2$—Z group, wherein Z is as defined in claim 1.

11 Claims, No Drawings

PROCESS FOR DYEING CELLULOSIC FIBRE MATERIALS WITH REACTIVE PHTHALOCYANINE DYES FROM BATH CONTAINING COLORLESS COMPOUNDS

The present invention relates to a novel process for dyeing cellulosic fibre materials with a mixture of a fibre-reactive phthalocyanine dye and a fibre-reactive colourless compound by the pad dyeing process.

Pad dyeing processes, especially the cold pad batch process, are known processes for dyeing cellulosic fibre materials. These processes make it possible to dye and fix textile fibre materials in bulk by impregnating the fibre substrates with the dye solution in a vat at the shortest possible liquor ratio and usually with only a single passage of the goods on the pad and, for example, by subsequently batching the goods for 1 to 48 hours.

In view of the increasingly stringent demands being made of dyeings obtained with reactive dyes in respect of efficiency, application technology and fastness standards, the current state of the art is in many respects not entirely satisfactory.

Specifically, the present invention relates to a process for dyeing cellulosic fibre materials with reactive dyes by the pad dyeing process, preferably by the cold pad batch process, in the presence of an assistant, which process comprises dyeing from an aqueous liquor containing a mixture of (a) at least one reactive dye of formula

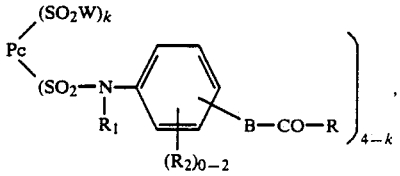

(1)

wherein Pc is the radical of a copper or nickel phthalocyanine, W is —OH and/or —N($R_3$)$R_4$, K is 1, 2 or 3, and $R_1$ is hydrogen or $C_1$–$C_4$alkyl which may be substituted by halogen, hydroxy, cyano, $C_1$–$C_4$alkoxy, $C_1$–$C_4$alkoxycarbonyl, carboxy, sulfo or sulfato, $(R_2)_{0-2}$ denotes 0 to 2 substituents selected from the group consisting of $C_1$–$C_4$alkyl, $C_1$–$C_4$alkoxy, halogen, carboxy or sulfo, $R_3$ and $R_4$ are each independently of the other hydrogen or $C_1$–$C_4$alkyl which may be substituted by hydroxy or sulfo, or wherein $R_3$ and $R_4$, when taken together, form a $C_4$–$C_5$alkylene radical which may be interrupted in the chain by a nitrogen or oxygen atom, B is a direct bond or a radical —$(CH_2)_n$— or —O—$(CH_2)_n$—, wherein n is 1,2,3,4,5 or 6; and R is a radical of formula

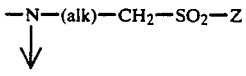

(2a)

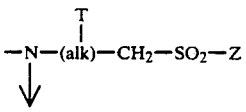

(2b)

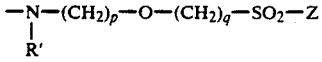

(2c)

-continued

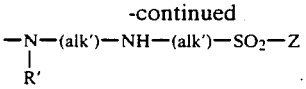

(2d)

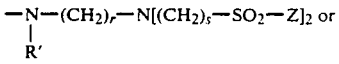

(2e)

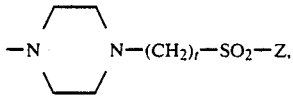

(2f)

wherein R′ is hydrogen or $C_1$–$C_6$alkyl, alk is a $C_1$–$C_7$alkylene radical or the branched isomers thereof, T is hydrogen, halogen, hydroxy, sulfato, carboxy, cyano, $C_1$–$C_4$alkanoyloxy. $C_1$–$C_4$alkoxycarbonyl, carbamoyl or a —$SO_2$—Z radical, V is hydrogen, unsubstituted or substituted $C_1$–$C_4$alkyl or a radical of formula

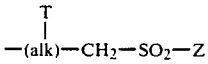

(2g)

wherein (alk) is as defined above, alk′ is a polymethylene radical of 2 to 6 carbon atoms or the branched isomers thereof, Z is β-sulfatoethyl, β-thiosulfatoethyl, β-phosphatoethyl, β-acyloxyethyl, β-haloethyl or vinyl, p, q, r and t are each independently of one another 1,2,3,4,5 or 6, and s is 2,3,4,5 or 6; and (b) at least one colourless compound which contains a —$SO_2$—Z group, wherein Z has the given meaning.

Surprisingly, the process of this invention yields especially good results. Thus the addition of a fibre-reactive colourless compound which contains a —$SO_2$—Z group markedly improves the degree of fixation obtainable by the cold pad batch process, the resultant dyeings can be washed off more readily, and a greater depth of shade is obtained, i.e. to obtain dyeings of the same tinctorial strength, a smaller amount of dye is needed in the process of this invention than in the known cold pad batch processes of the prior art. Further, the process of this invention results in insignificant pollution of the wastewater.

$R_1$ and $R_2$ as $C_1$–$C_4$alkyl are typically: methyl, ethyl, n-propyl, isopropyl, tert-butyl, n-butyl, isobutyl and sec-butyl, which radicals may be substituted by halogen, hydroxy, cyano, $C_1$–$C_4$alkoxy, $C_1$–$C_4$alkoxycarbonyl, carboxy, sulfo and sulfato. Examples of such substituted radicals are: carboxymethyl, β-carboxyethyl, β-carboxypropyl, methoxycarbonylmethyl, β-methoxyethyl, β-chloroethyl, β-hydroxyethyl, β-cyanoethyl, sulfomethyl, β-sulfoethyl and β-sulfatoethyl. The preferred meaning of $R_1$ is hydrogen, methyl or ethyl.

$R_2$ as $C_1$–$C_4$alkoxy is suitably: methoxy, ethoxy, isopropoxy, n-propoxy, isobutoxy, tertbutoxy, sec-butoxy and n-butoxy, which radicals may be substituted, for example by $C_1$–$C_4$alkoxy. Such a radical is typically the β-ethoxyethoxy radical.

$R_2$ as halogen may be fluoro, chloro or bromo.

Each of $R_3$ and $R_4$ independently of the other as $C_1$–$C_4$alkyl is suitably methyl, ethyl, n-propyl, isopropyl, n-butyl, isobutyl, sec-butyl and tert-butyl, which radicals may be substituted by hydroxy or sulfo. Exemplary of such radicals are β-hydroxyethyl, sulfomethyl, β-sulfoethyl.

If $R_3$ and $R_4$ together form a $C_4$–$C_5$alkylene radical which may be substituted by a —N or —O atom then $R_3$ and $R_4$, together with the linking nitrogen atom, may suitably be for example piperidyl, morpholinyl or piperazinyl.

The radical B contains 1 to 6, preferably 1 to 4, carbon atoms. Examples of B are: methylene, ethylene, propylene, butylene, methyleneoxy, ethyleneoxy, propyleneoxy and butyleneoxy. Where B is a $—O—(CH_2)_n—$ radical, B is linked to the benzene ring through the oxygen atom. Preferably B is a direct bond.

A β-haloethyl radical Z is preferably the β-chloroethyl radical; and the β-acyloxyethyl radical is preferably the β-acetoxyethyl radical. The alkylene radical alk is preferably methylene, ethylene, methylmethylene, propylene or butylene. The substituent T as alkanoyloxy radical is preferably acetyloxy, propionyloxy or butyryloxy; and as alkoxycarbonyl radical T is preferably methoxycarbonyl, ethoxycarbonyl or propoxycarbonyl. An alkyl radical V may be methyl, ethyl, propyl, isopropyl, butyl, isobutyl, sec-butyl or tert-butyl. Derivatives of the carboxy or sulfo group are carbamoyl, N-methylcarbamoyl, N-ethylcarbamoyl, N,N-dimethylcarbamoyl and N,N-diethylcarbamoyl, cyano, acetyl, propionyl, butyryl, methoxycarbonyl, ethoxycarbonyl, propoxycarbonyl, sulfamoyl, N-methylsulfamoyl, N-ethylsulfamoyl, N,N-dimethylsulfamoyl and N,N-diethylsulfamoyl, methylsulfonyl, ethylsulfonyl and propylsulfonyl. The radical R' is typically methyl, ethyl, propyl, isopropyl, butyl, isobutyl, sec-butyl, tert-butyl, pentyl or hexyl, or is preferably hydrogen. The polymethylene radicals alk' are preferably ethylene, propylene or butylene. The indices p, q and t are independent of one another and are preferably 2, 3 or 4. The indices r and s are each independently of the other preferably 2.

If T is a $—SO_2—Z$ radical and R' is hydrogen, then the radical of formula (2) preferably has the formula $$—NH—CH_2—\underset{\underset{SO_2—Z'}{|}}{CH}(CH_2)_{2-6}SO_2—Z \qquad (2g)$$

wherein Z and Z' are each independently of the other β-sulfatoethyl, β-thiosulfatoethyl, β-phosphatoethyl, β-acyloxyethyl, β-haloethyl or vinyl. An important variant of the formula of this radical is $$—NH—CH_2—\underset{\underset{SO_2—Z'}{|}}{CH}(CH_2)_3SO_2—Z \qquad (2h)$$

wherein Z=Z' and Z and Z' are as defined above. Preferably Z and Z' are β-sulfatoethyl, β-chloroethyl or vinyl.

In the process of this invention, those compounds are termed colourless whose absorption maximum is outside the visible range of the spectrum and whose absorption in the visible range is very insignificant.

The colourless organic compound used in the process of this invention is a compound having "fibre-reactive" character, i.e. under dyeing conditions this compound behaves as a reactive dye through being capable of forming covalent linkage with the fibre substrate.

The colourless organic compounds contain one or more fibre-reactive $—SO_2—Z$ groups.

Surprisingly, the process of this invention can be used equally well both for dyeing pure cellulosic fibres, such as mercerised or causticised or bleached cotton or viscose rayon, and for dyeing cellulose-containing fibre blends such as polyester/cellulose blends.

The amount of dye used in the process of this invention will depend as a rule on the desired depth of shade. Amounts ranging from 0.05 g/l to 100 g/l in the aqueous padding liquor have proved useful.

It is also possible to use mixtures of reactive dyes of formula (1) and mixtures of colourless fibre-reactive compounds in the process of the invention.

The fibre material to be dyed should exhibit neutral reaction and have a good absorption capacity. The reactive dye and the colourless compound are added, with stirring, to water of, for example, 20° to 30° C. For padding, it is possible to use for example known vats of U- or V-shaped cross-section and having divider inserts. The volume of the liquor should preferably be kept small in order to ensure a rapid liquor uptake. The immersion time is usually from 1 to 4 seconds. A padding temperature range from 20° to 30° C. has proved very suitable. The pick-up is normally 50 to 120%, preferably 60 to 80%, for cotton, and 80 to 100% for viscose rayon. The normal procedure is that dye and alkali solution are prepared separately and fed overnight into the padding vat by means of a mixing or metering device. Mixing of the two solutions is thus effected immediately before padding. After padding, the goods are batched up evenly and wrapped in a plastic sheet. During fixation, the goods must be protected from cooling or heating and from loss of moisture. The fixation rate depends on the chosen substrate and the temperature. Fixation times of 3 to 24, preferably from 3 to 8, hours at room temperature suffice as a rule.

The fixation alkalies customarily used for cold pad batch processes can be used as fixation alkalies. For carrying out the process of this invention in the alkaline pH range it has proved especially useful to use, for example, sodium hydroxide, potassium hydroxide, trisodium phosphate, disodium phosphate, sodium carbonate or mixtures of sodium carbonate with neutral salts such as sodium chloride and, in particular, water glass, as alkaline acid acceptors. Water glass is the term given to the vitreous solidified melts of alkali metal silicates. It is also possible to use mixtures of the cited acid acceptors. In the process of this invention it is preferred to use a mixture of water glass and sodium hydroxide.

In the process of this invention the liquor contains one or more of the cited acid acceptors and, if desired, conventional additives such as wetting agents, for example dioctyl sulfosuccinate, and thickeners, for example alginate thickeners, and neutral inorganic salts such as alkali metal chlorides or alkali metal sulfates.

After fixation, the dyeings are rinsed thoroughly with cold and hot water, with the optional addition of an agent which acts as dispersant and promotes the diffusion of unfixed dye.

The preferred procedure is that the dyed goods are washed off in an aqueous washing liquor at a pH of 8.5 to 9 and at elevated temperature, preferably in the range from 70° to 85° C., in the absence or in the presence of a nonionic detergent.

A preferred embodiment of the process of this invention comprises using, as colourless compound, a cycloaliphatic amine or, in particular, an aromatic amine, which contains a $—SO_2—Z$ group.

A suitable cycloaliphatic amine is, for example, a piperazine compound which contains a $—SO_2—Z$ group. A suitable aromatic amine is, for example, an aniline or naphthylamine which contains a $-SO_2-Z$ group.

An especially preferred embodiment of the process of the invention comprises using mixtures of at least one reactive dye of formula (1) with at least one colourless compound of formula (3a)

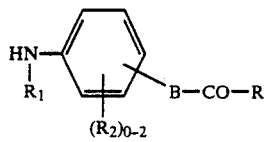

(3b)

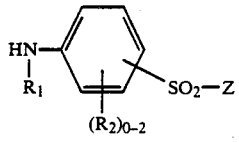

(3c)

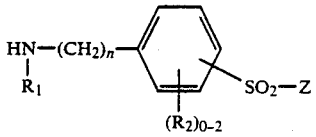

or (3d)

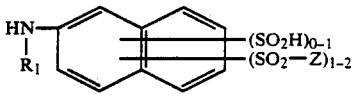

wherein $R_1$, $(R_2)_{0-2}$, B, R, Z and n are as defined for formula (1), but are independent of the corresponding radicals and indices in formula (1).

A still more preferred embodiment of the process of this invention comprises using mixtures containing (a) at least one reactive dye of formula (4)

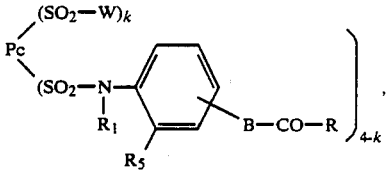

wherein Pc is the radical of a copper phthalocyanine, W is as defined for formula (1) and is preferably —OH or $-NH_2$, $R_1$ is hydrogen, methyl or ethyl, $R_5$ is hydrogen, methyl, methoxy, chloro or sulfo, B is a direct bond, $-CH_2-$ or $-O-CH_2CH_2-$, R is a radical of formula (2a)

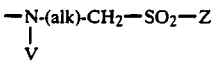

(2b)

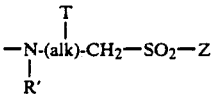

(2c)

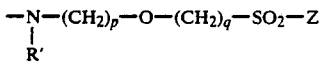

or

-continued (2f)

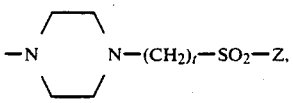

Z is β-sulfatoethyl, β-chloroethyl or vinyl, T is hydrogen or a $-SO_2-Z$ radical, wherein Z has the given meaning, and V is hydrogen or methyl, or V is a radical of formula (2g)

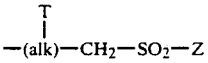

wherein Z has the given meaning, T is hydrogen, alk is $C_1$–$C_3$alkylene, R' is hydrogen, p is 2 and q is 2, and (b) at least one of the colourless compound of formula (5a)

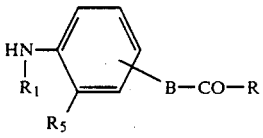

or (5b)

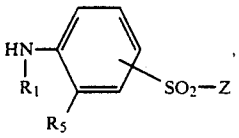

wherein $R_1$, $R_5$, B, R and Z have the given meanings but are independent of the corresponding radicals in formula (4).

An important embodiment of the process of this invention comprises using mixtures containing (a) at least one reactive dye of formula (4), wherein Pc, W, k, $R_1$, $R_5$ and B are as defined for formula (4), R is a radical of formula (2a), (2b) or (2c), Z, T, (alk), R', p and q are as defined for formula (4), and V is hydrogen or a radical of formula (2g), and (b) at least one colourless compound of formula (5a) or (5b).

A particularly important embodiment of the process of this invention comprises using mixtures containing (a) a reactive dye of formula (6)

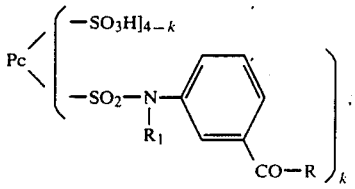

wherein $R_1$ is hydrogen or methyl, k is 1.5 to 2.5, and R is a radical of formula (7)

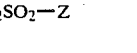

(8)

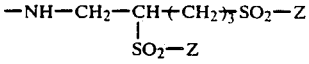

-continued

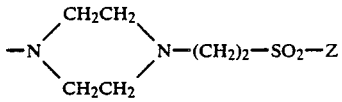

(9)

or

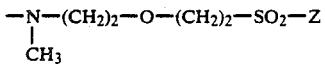

(10)

and (b) a compound of formula

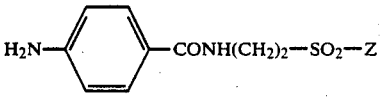

(11)

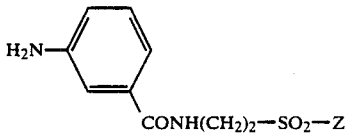

(12)

or

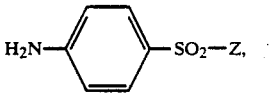

(13)

wherein Z is β-sulfatoethyl, β-chloroethyl or vinyl.

A particularly preferred embodiment of the process of this invention comprises using mixtures containing (a) a reactive dye of formula

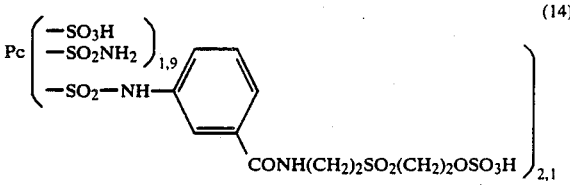

(14)

wherein Pc is as defined for formula (4), and (b) a compound of formula

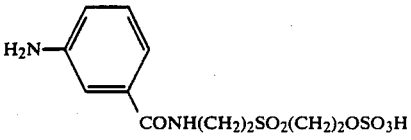

(15)

or

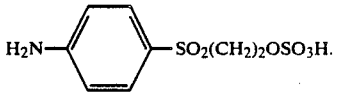

(16)

In the process of this invention it is preferred to use mixtures wherein the ratio of the reactive dyes to the colourless compounds is from 1:1 to 100:1, preferably from 10:1 to 100:1, parts by weight.

The invention further relates to mixtures containing (a) at least 50 parts by weight of at least one reactive dye of formula (1), wherein Pc, W, k, $R_1$, $R_2$, B and R are as defined for formula (1), and (b) at least 0.5 part by weight of at least one colourless compound which contains at least one $—SO_2—Z$ group, wherein Z is as defined for formula (1).

Preferred mixtures are those wherein the colourless compound is a cycloaliphatic amine or, preferably, an aromatic amine, conveniently a compound of formula (3a), (3b), (3c) or (3d).

Particularly preferred mixtures are those which contain at least one reactive dye of formula (4) and at least one colourless compound of formula (5a) or (5b).

More particularly preferred mixtures are those which contain (a) a reactive dye of formula (6) and (b) a colourless compound of formula (11), (12) or (13).

The most preferred mixtures are those which contain (a) a reactive dye of formula (14) and (b) a colourless compound of formula (15) or (16).

The ratio of the reactive dyes to the colourless compounds is preferably from 1:1 to 100:1, most preferably from 10:1 to 100:1, parts by weight.

The invention further relates to aqueous dye formulations which contain a mixture of (a) at least one reactive dye of formula

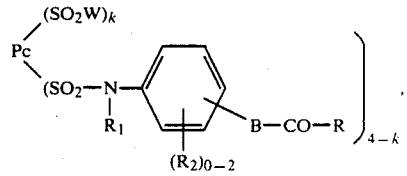

(1)

wherein Pc is the radical of a copper or nickel phthalocyanine, W is —OH and/or $—N(R_3)R_4$, k is 1,2 or 3, and $R_1$ is hydrogen or $C_1$–$C_4$alkyl which may be substituted by halogen, hydroxy, cyano, $C_1$–$C_4$alkoxy, $C_1$–$C_4$alkoxycarbonyl, carboxy, sulfo or sulfato, $(R_2)_{0-2}$ denotes 0 to 2 substituents selected from the group consisting of $C_1$–$C_4$alkyl, $C_1$–$C_4$alkoxy, halogen, carboxy or sulfo, $R_3$ and $R_4$ are each independently of the other hydrogen or $C_1$–$C_4$alkyl which may be substituted by hydroxy or sulfo, or wherein $R_3$ and $R_4$, when taken together, form a $C_4$–$C_5$alkylene radical which may be interrupted in the chain by a nitrogen or oxygen atom, B is a direct bond or a radical $—(CH_2)_n—$ or $—O—(CH_2(_n—$, wherein n is 1, 2, 3 4, 5 or 6; and R is a radical of formula

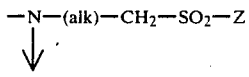

(2a)

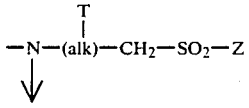

(2b)

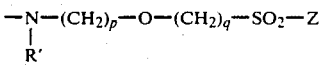

(2c)

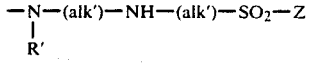

(2d)

-continued

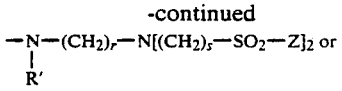

(2e)

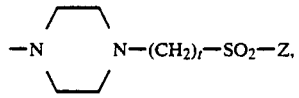

(2f)

wherein R' is hydrogen or $C_1$-$C_6$alkyl, alk is a $C_1$-$C_7$alkylene radical or the branched isomers thereof, T is hydrogen, halogen, hydroxy, sulfato, carboxy, cyano, $C_1$-$C_4$alkanoyloxy. $C_1$-$C_4$alkoxycarbonyl, carbamoyl or a $—SO_2—Z$ radical, V is hydrogen, unsubstituted or substituted $C_1$-$C_4$alkyl or a radical of formula

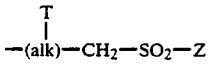

(2g)

wherein (alk) is as defined above, alk' is a polymethylene radical of 2 to 6 carbon atoms or the branched isomers thereof, Z is β-sulfatoethyl, β-thiosulfatoethyl, β-phosphatoethyl, β-acyloxyethyl, β-haloethyl or vinyl, p, q, r and t are each independently of one another 1, 2, 3, 4, 5 or 6, and s is 2, 3, 4, 5 or 6; and (b) at least one colourless compound which contains a $—SO_2—Z$ group, wherein Z has the given meaning.

The same preferences apply to the aqueous dye formulations as to the mixtures of this invention.

The dye formulations normally have a dye concentration of 5 to 20% by weight and a salt content (inorganic salts) of 1 to 30% by weight, especially 4 to 10% by weight. The pH is normally in the range from 3 to 10, preferably from 3 to 7. Insoluble constituents are separated by microfiltration. Enrichment and deionisation can be carried out until the dye concentration is in the range from 10 to 50% by weight. The salt content then falls to below 5% by weight, preferably to below 2% by weight and, most preferably, to below 1% by weight.

The temperature of the dye formulations may be in the range from 10° to 80° C., preferably from 20° to 60° C.

The concentrated dye formulations are distinguished by their high concentration of dye, their homogeneity and their good stability (over several months) in a wide temperature range (0° C. to 50° C.).

To prepare the concentrated dye formulations it is expedient to perform different separating operations, for example using membranes:

microfiltration of the aqueous solution of the crude dye to separate undissolved constituents ultrafiltration/hyperfiltration of the dye solution, whereby the solution is deionised to values below 1% by weight and the dye concentration is enriched to 15 to 45% by weight microfiltration of the concentrated dye solution to remove undissolved constituents subsequent preparation of the ready-for-use liquid or solid dye formulation.

The liquid dye formulations are usually aqueous and may contain, aside from water and the mixture of this invention, components conventionally used in liquid formulations, for example solubilisers, foam inhibitors, antifreeze agents, humectants, surfactants, buffer substances and/or microbicides.

To prepare a liquid physical form, the concentrated dye formulation, after addition of the optional conventional components and adjusting the pH, must only be brought to a predetermined final dye concentration by dilution and/or with the aid of extenders. Alternatively, however, the dye formulation, after the addition of optional auxiliaries such as binders, dust inhibitors, wetting agents, buffer substances and/or extenders, can also be converted into a solid dye formulation by dehydration. Because of the high dye concentration, less energy is need for drying. Conventional drying methods are used, preferably spray drying.

The dyeings obtained with the reactive dyes used in the practice of this invention have clear shades. High fixation rates and very good build-up are achieved, and the dyeings have good lightfastness and very good wetfastness properties.

The invention is illustrated by the following Examples in which parts and percentages are by weight.

EXAMPLE 1

A bleached cotton fabric is padded at 25° C. with a solution which contains 30 g/l of the dye of formula

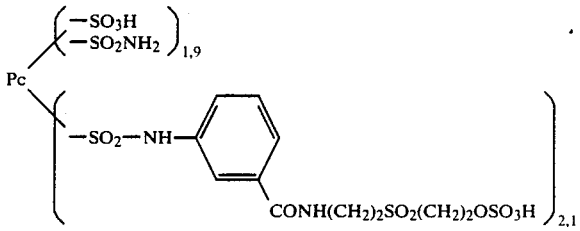

(101)

wherein Pc is the radical of a copper phthalocyanine, 21 ml/l of a 30% aqueous solution of NaOH, 70 ml/l of a water glass solution having a density of 1.356 at 15° (38 Bé), and 3 g/l of the compound of formula

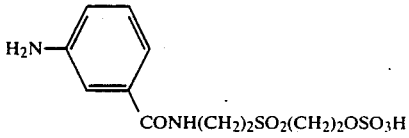

(102)

The cotton fabric is padded to a pick-up of 70% and then batched up on a roll, wrapped airtight in plastic, and stored for 24 hours at 25° C. The dyed fabric is then rinsed, soaped at the boil for a quarter of an hour with 2 g/l of a nonionic detergent (obtained by addition of 10 equivalents of ethylene oxide to p-nonylphenol), rinsed once more and dried.

For comparison purposes, the degree of fixation is determined (calculated from the extinction values (at λ max.) of the extraction solutions of the samples of the dyeings which have not been washed off, each time fixed and unfixed). The degree of fixation in this Example is 81%.

EXAMPLE 2

The procedure of Example 1 is repeated, using 6 g/l instead of 3 g/l of the compound of formula (102). The dyeing so obtained with the dye of formula (101) has a degree of fixation of 83.7%.

EXAMPLE 3

The procedure of Example 1 is repeated, replacing 3 g/l of the compound of formula (102) with 6 g/l of the compound of formula

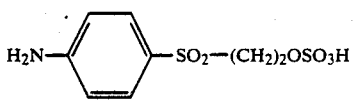

(103)

The dyeing so obtained with the dye of formula (101) has a degree of fixation of 83.6%.

COMPARISON EXAMPLE

The procedure of Example 1 is repeated, except that the cotton fabric is padded without the addition of the compound of formula (102). The dyeing so obtained with the compound of formula (101) has a degree of fixation of only 68% and a markedly lighter shade than the dyeings of Examples 1 to 3.

EXAMPLE 4

A mercerised cotton fabric is padded at 25° C. with a solution which contains 60 g/l of the salt-free dye of formula

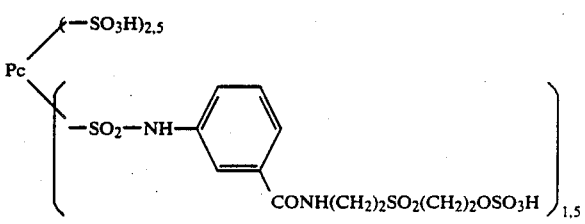

(104)

wherein Pc is the radical of a copper phthalocyanine, 31 ml/l of a 30% aqueous solution of NaOH, 70 ml/l of a water glass solution having a density of 1.356 at 15° (38 Bé). The cotton fabric is padded to a pick-up of 70% and then batched up on a roll, wrapped airtight in plastic, and stored for 24 hours at 25° C. The dyed fabric is then rinsed, soaped at the boil for a quarter of an hour with 2 g/l of a nonionic detergent (obtained by addition of 10 equivalents of ethylene oxide to p-nonylphenol), rinsed once more and dried.

By repeating the above procedure and using 53 g/l instead of 60 g/l of the dye of formula (104) and 7 g/l of the compound of formula (101) of Example 1, then a cotton fabric dyed in the same depth of shade and having enhanced washfastness properties is obtained.

EXAMPLE 5

The procedure of Example 4 is repeated, replacing 60 g/l of the dye of formula (104) with 83 g/l of the salt-free dye of formula

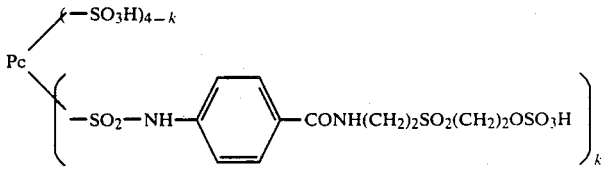

(105)

wherein Pc is the radical of a phthalocyanine radical and k is 1.75, to give a dyeing of the same depth of shade as that obtained with 70 g/l of the dye of formula (105) and 10 g/l of the compound of formula

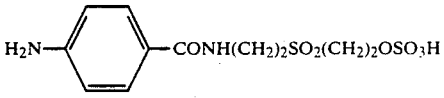

(106)

Comparably good results are obtained by repeating the above procedure and using dyes wherein k=2.0 to k=2.5.

EXAMPLES 6 TO 17

The procedures described in Examples 1 to 5 are repeated, using a dye of formula

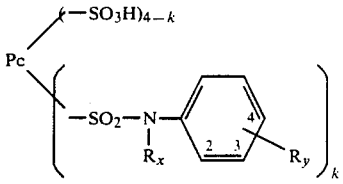

wherein Pc is the radical of a copper phthalocyanine, $R_x$, $R_y$ and k are as defined in columns 2, 3 and 4, respectively, of the following Table, and, as colourless compound, at least 5% by weight, based on the dye employed, of the compounds listed in column 5 of the Table. Compared with the dyeings obtained without colourless compounds, the resultant dyeings have markedly better fixation and depth of shade values.

Table

| Example | $R_x$ | $R_y$ | k | colourless compound of formula |
|---|---|---|---|---|
| 6 | H | 4-$CONHCH_2CH_2SO_2CH_2CH_2OSO_3H$ | 2.0 | (102) |
| 7 | H | 3-$CONHCH_2CH_2SO_2CH_2CH_2OSO_3H$ | 1.5 | (106) |
| 8 | H | 3-$CONHCH_2CH_2SO_2CH_2CH_2OSO_3H$ | 2.5 | (106) |
| 9 | H | 4-$CONHCH_2CH_2SO_2CH_2CH_2OSO_3H$ | 1.75 | (103) |
| 10 | H | 4-$CONHCH_2CH_2SO_2CH{=}CH_2$ | 2.0 | (106) |
| 11 | H | 4-$CONHCH_2CH(SO_2CH{=}CH_2)C_3H_6SO_2CH{=}CH_2$ | 1.0 | (102) |
| 12 | H | 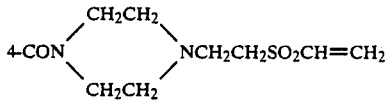 | 1.5 | (106) |
| 13 | H | 4-$CON(CH_3)CH_2CH_2OCH_2CH_2SO_2CH{=}CH_2$ | 1.75 | (106) |
| 14 | $CH_3$ | 3-$CONHCH_2CH_2SO_2CH_2CH_2OSO_3H$ | 1.75 | (102) |
| 15 | $CH_3$ | 4-$CONHCH_2CH_2SO_2CH_2CH_2OSO_3H$ | 1.5 | (103) |
| 16 | H | 4-$CONHCH_2CH_2SO_2CH_2CH_2OSO_3H$ | 1.5 | (103) |
| 17 | H | 2-$CONHCH_2CH_2SO_2CH_2CH_2OSO_3H$ | 1.5 | (102) |

What is claimed is:

1. A process for dyeing cellulosic fiber materials with reactive dyes by the pad process in the presence of an assistant, which process comprises dyeing from an aqueous liquor containing a mixture of (a) at least one reactive dye of formula

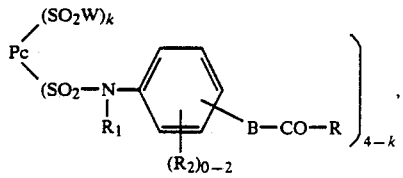

(1)

wherein Pc is the radical of a copper or nickel phthalocyanine, W is —OH and/or —$N(R_3)R_4$, k is 1, 2 or 3, and $R_1$ is hydrogen or $C_1$–$C_4$alkyl which may be substituted by halogen, hydroxy, cyano, $C_1$–$C_4$alkoxy, $C_1$–$C_4$alkoxycarbonyl, carboxy, sulfo or sulfato, $(R_2)_{0-2}$ denotes 0 to 2 substituents selected from the group consisting of $C_1$–$C_4$alkyl, $C_1$–$C_4$alkoxy, halogen, carboxy or sulfo, $R_3$ and $R_4$ are each independently of the other hydrogen or $C_1$–$C_4$alkyl which may be substituted by hydroxy or sulfo, or wherein $R_3$ and $R_4$, when taken together, form a $C_4$–$C_5$alkylene radical which may be interrupted in the chain by a nitrogen or oxygen atom, B is a direct bond or a radical —$(CH_2)_n$— or —O—$(CH_2)_n$—, wherein n is 1, 2, 3 4, 5 or 6; and R is a radical of formula

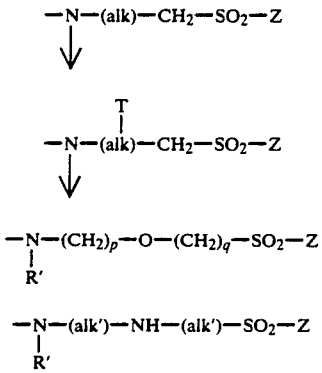

(2a)

(2b)

(2c)

(2d)

-continued

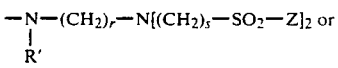

(2e)

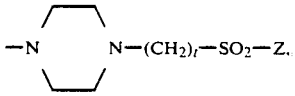

(2f)

wherein R′ is hydrogen or $C_1$–$C_6$alkyl, alk is a $C_1$–$C_7$alkylene radical or the branched isomers thereof, T is hydrogen, halogen, hydroxy, sulfato, carboxy, cyano, $C_1$–$C_4$alkanoyloxy. $C_1$–$C_4$alkoxycarbonyl, carbamoyl or a —$SO_2$—Z radical, V is hydrogen, unsubstituted or substituted $C_1$–$C_4$alkyl or a radical of formula

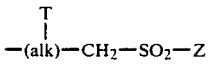

(2g)

wherein (alk) is as defined above, alk′ is a polymethylene radical of 2 to 6 carbon atoms or the branched isomers thereof, Z is β-sulfatoethyl, β-thiosulfatoethyl, β-phosphatoethyl, β-acyloxyethyl, β-haloethyl or vinyl, p, q, r and t are each independently of one another 1, 2, 3, 4, 5 or 6, and s is 2, 3, 4, 5 or 6; and (b) at least one colourless compound of the formula

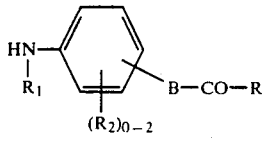

(3a)

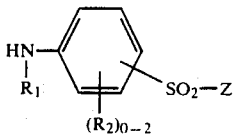

(3b)

-continued (3c)

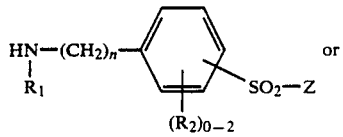

or (3d)

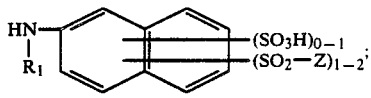

wherein the ratio of (a) to (b) is from 1:1 to 1:100 parts by weight.

2. A process according to claim 1, wherein dyeing is carried out by the pad cold batch process.

3. A process according to claim 1, which comprising the use of a mixture containing (a) at least one reactive dye of formula (4)

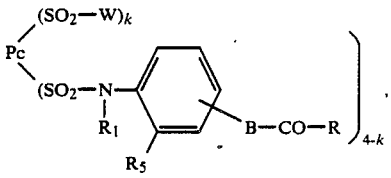

wherein Pc is the radical of copper phthalocyanine, W is OH or $NH_2$, k is 1, 2 or 3, $R_1$ is hydrogen, methyl or ethyl, $R_5$ is hydrogen, methyl, methoxy, chloro or sulfo, B is a direct bond, $—CH_2—$ or $—O—CH_2CH_2—$, R is a radical of formula (2a)

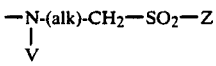

(2b)

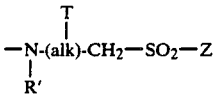

(2c)

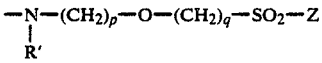

or (2f)

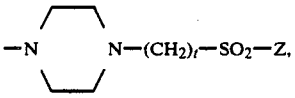

Z is β-sulfatoethyl, β-chloroethyl or vinyl, T is hydrogen or a $—SO_2—Z$ radical, wherein Z has the given meaning, and V is hydrogen or methyl, or V is a radical of formula (2g)

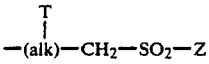

wherein Z has the given meaning, T is hydrogen, alk is $C_1$–$C_3$alkylene, R' is hydrogen, p is 2 and q is 2, and (b) at least one of the colourless compound of formula (5a)

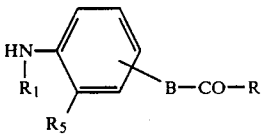

or (5b)

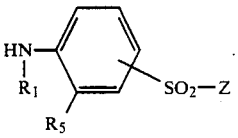

4. A process according to claim 3, which comprises the use of a mixture containing (a) at least one reactive dye of formula (4), wherein Pc, W, k, $R_1$, $R_5$ and B are as defined in claim 6, R is a radical of formula (2a), (2b) or (2c), Z, T, (alk), R', p and q are as defined in claim 6, and V is hydrogen or a radical of formula (2g), and (b) at least one colourless compound of formula (5a) or (5b).

5. A process according to claim 3, which comprises the use of a mixture containing (a) a reactive dye of formula (6)

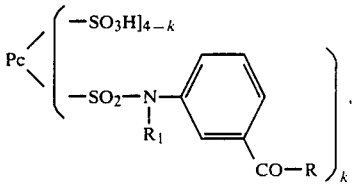

wherein $R_1$ is hydrogen or methyl, k is 1.5 to 2.5, and R is a radical of formula (7)

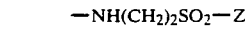

(8)

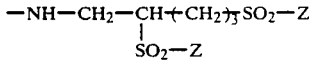

(9)

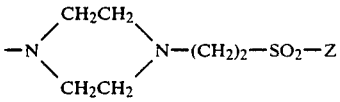

or (10)

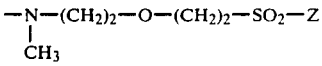

and (b) a compound of formula (11)

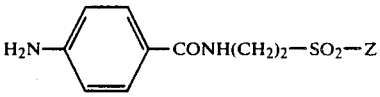

-continued (12)

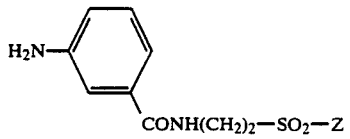

or (13)

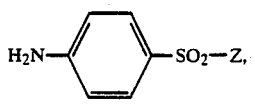

wherein Z is β-sulfatoethyl, β-chloroethyl or vinyl.

6. A process according to claim 4, which comprises the use of a mixture containing (a) a reactive dye of formula (14)

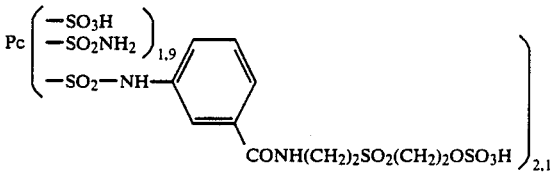

and (b) a compound of formula (15)

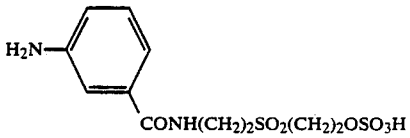

or (16)

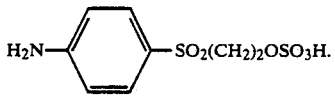

7. A process according to claim 1, wherein the ratio of reactive dye to colourless compound is from 10:1 to 100:1 parts by weight.

8. A process according to claim 1, wherein the cellulosic fibre material is cotton.

9. A mixture comprising (a) at least one reactive dye of formula (1)

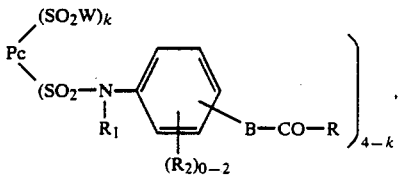

wherein Pc is the radical of a copper or nickel phthalocyanine, W is —OH and/or —N($R_3$)$R_4$, k is 1, 2 or 3, and $R_1$ is hydrogen or $C_1$–$C_4$alkyl which may be substituted by halogen, hydroxy, cyano, $C_1$–$C_4$alkoxy, $C_1$–$C_4$alkoxycarbonyl, carboxy, sulfo or sulfato, $(R_2)_{0-2}$ denotes 0 to 2 substituents selected from the group consisting of $C_1$–$C_4$alkyl, $C_1$–$C_4$alkoxy, halogen, carboxy or sulfo, $R_3$ and $R_4$ are each independently of the other hydrogen or $C_1$–$C_4$alkyl which may be substituted by hydroxy or sulfo, or wherein $R_3$ and $R_4$, when taken together, form a $C_4$–$C_5$alkylene radical which may be interrupted in the chain by a nitrogen or oxygen atom, B is a direct bond or a radical —$(CH_2)_n$— or —O—$(CH_2)_n$—, wherein n is 1, 2, 3, 4, 5 or 6; and R is a radical of formula

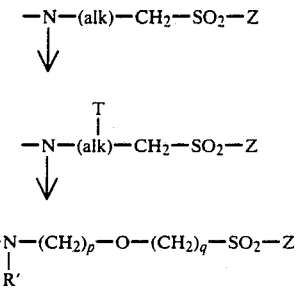

(2a)

(2b)

(2c)

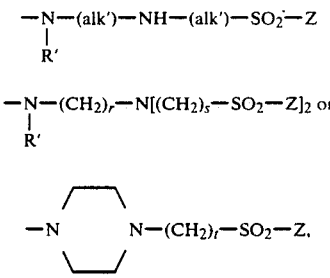

(2d)

(2e)

(2f)

wherein R′ is hydrogen or $C_1$–$C_6$alkyl, alk is a $C_1$–$C_7$alkylene radical or the branched isomers thereof, T is hydrogen, halogen, hydroxy, sulfato, carboxy, cyano, $C_1$–$C_4$alkanoyloxy. $C_1$–$C_4$alkoxycarbonyl, carbamoyl or a —$SO_2$—Z radical, V is hydrogen, unsubstituted or substituted $C_1$–$C_4$alkyl or a radical of formula

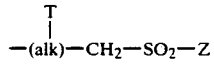

(2g)

wherein (alk) is as defined above, alk′ is a polymethylene radical of 2 to 6 carbon atoms or the branched isomers thereof, Z is β-sulfatoethyl, β-thiosulfatoethyl, β-phosphatoethyl, β-acyloxyethyl, β-haloethyl or vinyl, p, q, r and t are each independently of one another 1, 2, 3, 4, 5 or 6, and s is 2, 3, 4, 5 or 6; and (b) at least 0.5% by weight of at least one colourless compound of the formula (3a)

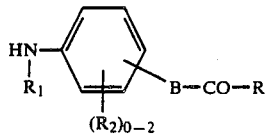

(3b)

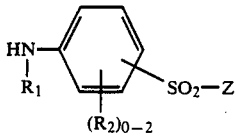

(3c)

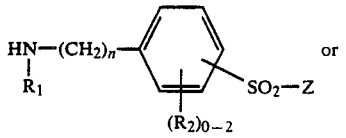

or (3d)

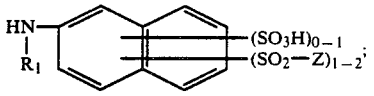

wherein the ratio of (a) to (b) is 1:1 to 1:100 parts by weight.

10. A mixture according to claim 9, wherein the ratio of reactive dye to colourless compound is from from 10:1 to 100:1.

11. An aqueous dye formulation which contains a mixture of (a) at least one reactive dye of formula (1)

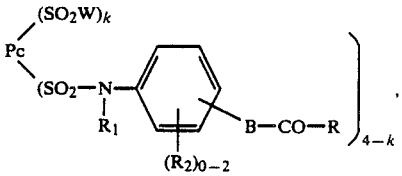

wherein Pc is the radical of a copper or nickel phthalocyanine, W is —OH and/or —N($R_3$)$R_4$, k is 1, 2 or 3, and $R_1$ is hydrogen or $C_1$-$C_4$alkyl which may be substituted by halogen, hydroxy, cyano, $C_1$-$C_4$alkoxy, $C_1$-$C_4$alkoxycarbonyl, carboxy, sulfo or sulfato, $(R_2)_{0-2}$ denotes 0 to 2 substituents selected from the group consisting of $C_1$-$C_4$alkyl, $C_1$-$C_4$alkoxy, halogen, carboxy or sulfo, $R_3$ and $R_4$ are each independently of the other hydrogen or $C_1$-$C_4$alkyl which may be substituted by hydroxy or sulfo, or wherein $R_3$ and $R_4$, when taken together, form a $C_4$-$C_5$alkylene radical which may be interrupted in the chain by a nitrogen or oxygen atom, B is a direct bond or a radical —$(CH_2)_n$— or —O—$(CH_2)_n$—, wherein n is 1, 2, 3, 4, 5 or 6; and R is a radical of formula (2a)

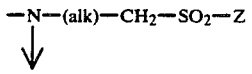

-continued (2b)

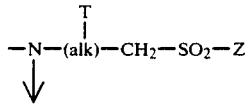

(2c)

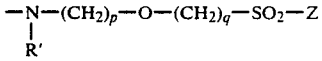

(2d)

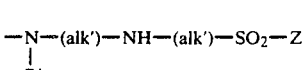

(2e)

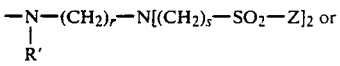

(2f)

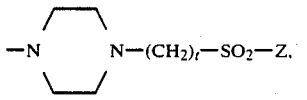

wherein R′ is hydrogen or $C_1$-$C_6$alkyl, alk is a $C_1$-$C_7$alkylene radical or the branched isomers thereof, T is hydrogen, halogen, hydroxy, sulfato, carboxy, cyano, $C_1$-$C_4$alkanoyloxy, $C_1$-$C_4$alkoxycarbonyl, carbamoyl or a —$SO_2$—Z radical, V is hydrogen, unsubstituted or substituted $C_1$-$C_4$alkyl, or a radical of formula (2g)

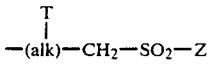

wherein (alk) is as defined above, alk′ is a polymethylene radical of 2 to 6 carbon atoms or the branched isomers thereof, Z is β-sulfatoethyl, β-thiosulfatoethyl, β-phosphatoethyl, β-acyloxyethyl, β-haloethyl or vinyl, p, q, r and t are each independently of one another 1, 2, 3, 4, 5 or 6, and s is 2, 3, 4, 5 or 6; and (b) at least one colourless compound of the formula (3a)

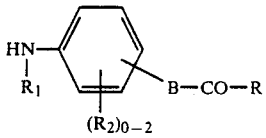

(3b)

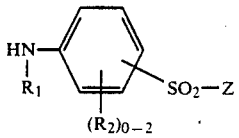

(3c)

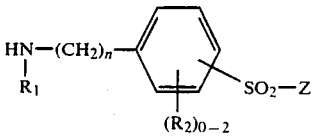

or (3d)

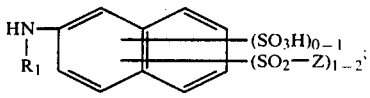

wherein the ratio of (a) to (b) is from 1:1 to 1:100 parts by weight.

* * * * *